United States Patent [19]

Sciolotto

[11] 4,129,157

[45] Dec. 12, 1978

[54] TOOL FOR TENSIONING AND CUTTING SELF-LOCKING STRAPS

[75] Inventor: Alessandro Sciolotto, Turin, Italy

[73] Assignee: ITW Fastex Italia, Sp.A, Turin, Italy

[21] Appl. No.: 847,628

[22] Filed: Nov. 1, 1977

[30] Foreign Application Priority Data

Nov. 25, 1976 [IT] Italy ..... 29737 A/76

[51] Int. Cl.[2] ..... B21F 9/02

[52] U.S. Cl. ..... 140/123.6; 140/93.2

[58] Field of Search ..... 140/93 A, 93.2, 123.6; 254/51, 73

[56] References Cited

U.S. PATENT DOCUMENTS 3,344,815 10/1967 Lawson et al. ..... 140/93.2

*Primary Examiner*—Lowell A. Larson

*Attorney, Agent, or Firm*—Jack R. Halvorsen; Robert W. Beart

[57] ABSTRACT

A tool for tightening and cutting self-locking straps is provided. This tool is of the type comprising a pair of jaws to restrain and tension the tail of the self-locking strap, a lever for actuating said jaws, a lever for actuating a blade cutting the exceeding portion of strap and a device for locking the blade actuating lever which unlocks the lever only when the tension exerted on the strap has reached a predetermined value. One of the jaws is integral with the jaw actuating lever and the other jaw is integral with a slide sliding on a guide means parallel to the direction of strap tensioning against the reaction of a spring placed between slide and tool body. The jaw actuating lever is fulcrumed on the slide means.

11 Claims, 12 Drawing Figures

TOOL FOR TENSIONING AND CUTTING SELF-LOCKING STRAPS

This invention relates to tools for tensioning and cutting self-locking straps.

Self-locking straps used for binding in a bundle a plurality of thread-shaped elements, such as metal wires, electric conductors etc. and for locking these elements in the so obtained bundle are known. These straps ae generally formed of flexible strips of plastic material, having an enlarged end so as to form a head provided with a slot and the opposite end provided with teeth. In order to bind a group of thread-shaped elements to each other the strip portion is wrapped about this group of elements forming a bundle and the toothed end is inserted into the slot in the head and passed therethrough, and then the part exiting from the head is tensioned so as to tighten the thread-shaped elements to each other and lock them in this position. Once the desired locking degree is achieved, this exiting part is released but the strip portion wrapping the elements cannot loose because the strip teeth irreversibly engage a tooth lying in the head slot. At this point the exceeding portion of strip projecting from the slot can be cut for practical and aesthetical reasons.

Various tools for tensioning and cutting self-locking straps of this kind have already been proposed, most of which however, are of a very complex design. Furthermore, many of these tools have a tightening stroke rather short and require pinching of the strip tail over a very extended portion thereof.

This invention is intended to provide a tool for tensioning and cutting self-locking straps of the above kind, which does not present the disadvantages of the known tools of this type.

More particularly, the tool according to this invention is of the type comprising two jaws intended to restrain and tension the tail of the self-locking strap, a lever for actuating said jaws, a lever for actuating a blade intended to cut the exceeding portion of said strap and a device for locking said blade actuating lever which unlocks said lever only when the tension exerted on said strap has reached a predetermined value, and is characterized in that one of the jaws is integral with said jaw actuating lever and the other jaw is integral with a slide adapted to slide on a guide parallel to the direction in which said strap is tensioned against the reaction of a spring interposed between said slide and a tool body, said jaw actuating lever being pivotally mounted on said slide.

According to a feature of the invention the device for locking the blade actuating lever has a handle pivotally mounted at an end to the tool body and engaging at its opposite end said tool body by means of a release device, said handle being connected by means of a linkage to said blade actuating lever and being arranged so as to be gripped together with said jaw actuating lever.

The above as well as other features of the invention will be apparent from the following detailed description of an embodiment thereof, given merely by way of example and therefore not intended in a limiting sense, in connection with the accompanying drawings, wherein.

Referring first to FIGS. 1 to 4, there is shown a tool comprising a support structure or body 1, having substantially the shape of a pistol with a barrel portion 2 and a grip portion 3.

Figure 1:
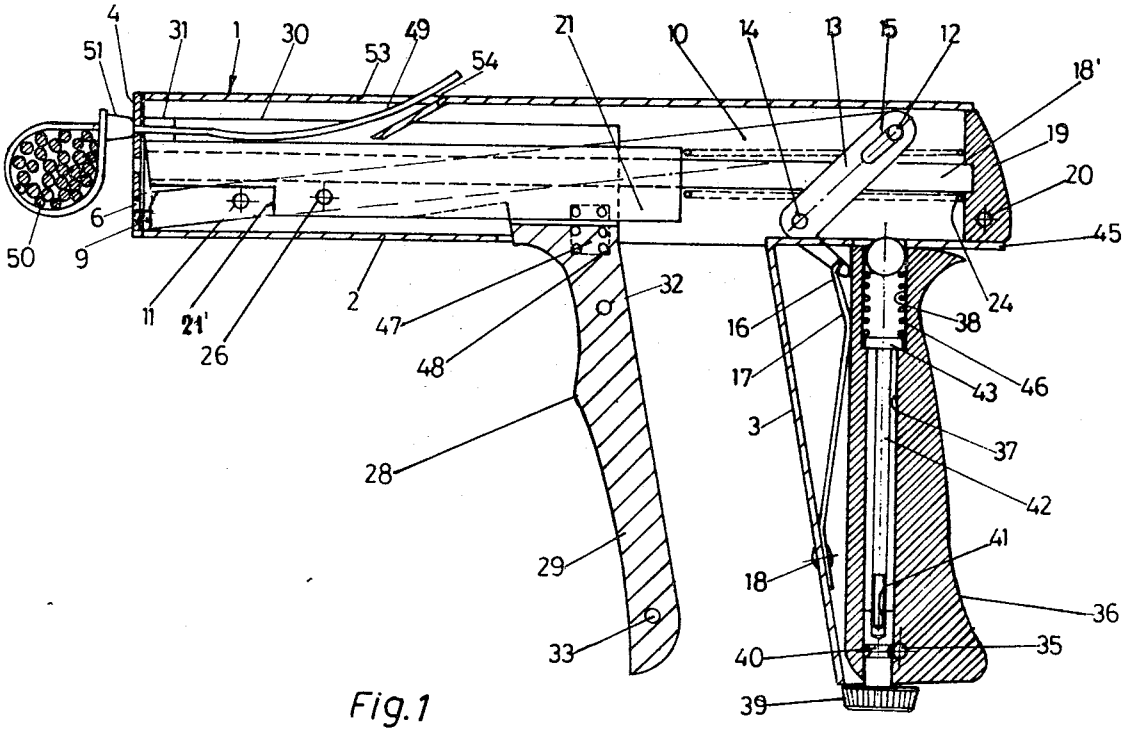
FIG. 1 is a side elevational section view of a tool according to the invention.
Figure 2:
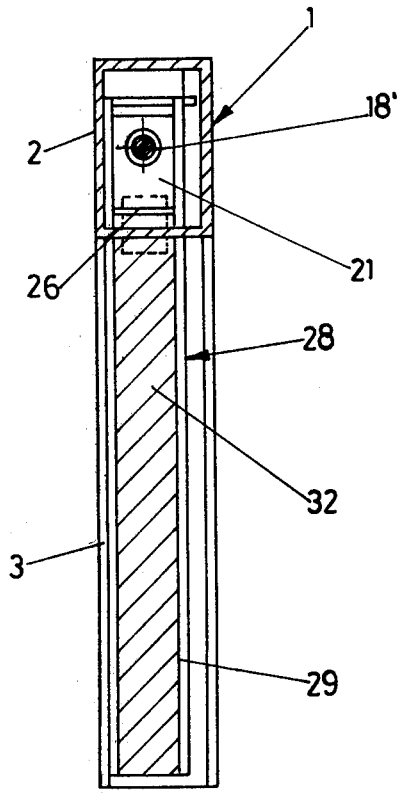
FIG. 2 is a front elevational section view of the tool shown in FIG. 1.
Figure 4:
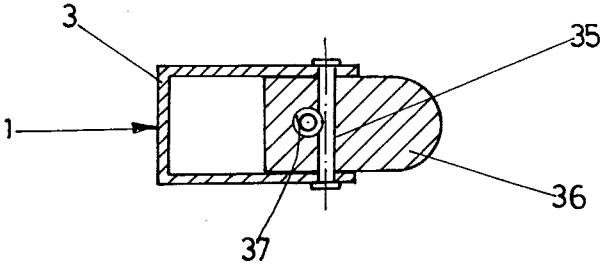
FIG. 4 is a cross-sectional view of the handle of tool shown in FIGS. 1 to 3.
Figure 3:
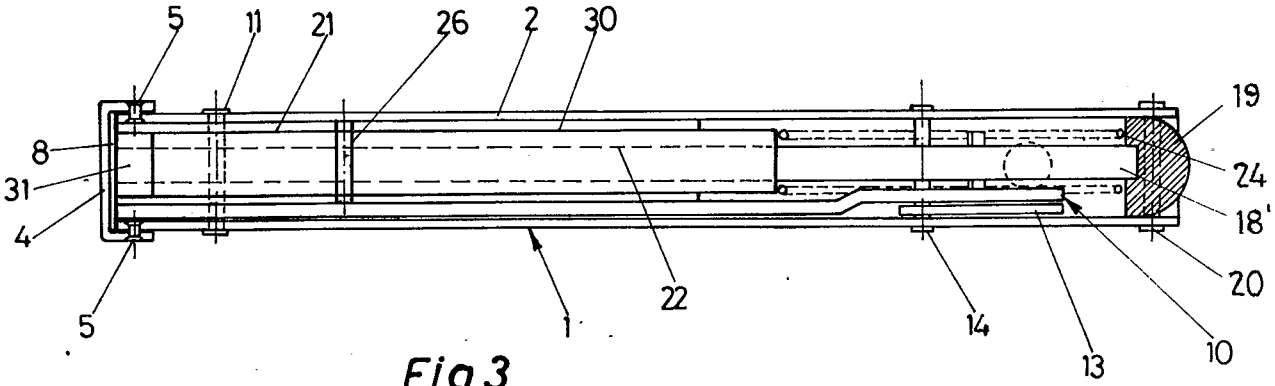
FIG. 3 is a top sectional view of the tool shown in FIGS. 1 and 2.
Figure 5:
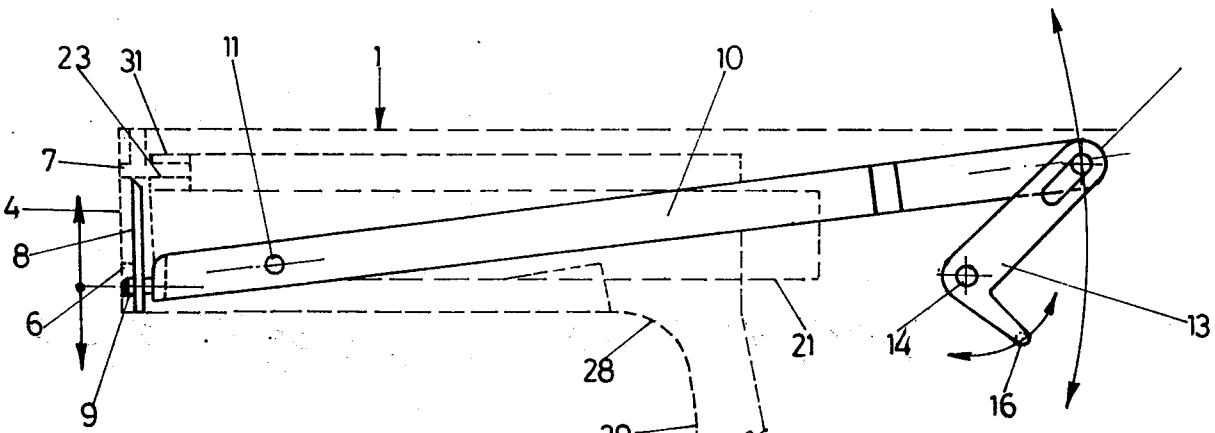
FIG. 5 is a side elevation view of the cutting device of the tool shown in FIGS. 1 to 3.
Figure 6:
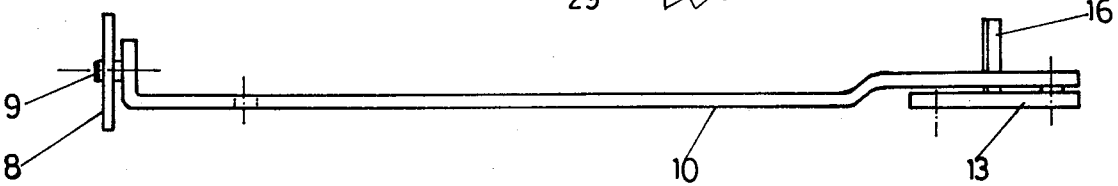
FIG. 6 is a plan view of the device shown in FIG. 5.
Figure 7:
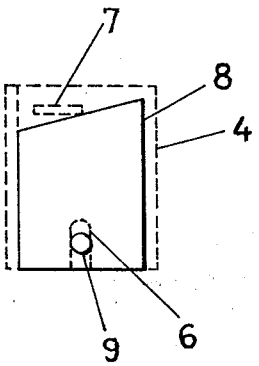
FIG. 7 is a front elevation view of the blade of the cutting device shown in FIGS. 5 and 6.

The barrel portion 2 is closed at one end by a U-shaped plate 4 fastened to the side walls of the barrel portion by means of rivets 5. As shown in dotted lines in FIG. 7, the front wall of the plate 4 is provided in the lower portion thereof with a blade guiding vertical slot 6, which will be discussed below and with a horizontal slot 7 for the introduction of the strap tail. This front wall of plate 4 is spaced from the facing end of the barrel portion 2 of body 1 so as to permit a cutting blade 8 to be inserted therebetween. This blade is supported with a clearance by a pin 9 positioned at the end of a lever 10, as best shown in FIGS. 5 to 7. Lever 10 is pivotally mounted on a pivot-pin 11 supported by the side walls of the barrel portion 2 of body 1 and at the end opposite that carrying the blade 8 is linked by means of a pin 12 to a bell-crank lever 13 pivotally mounted on a pivot-pin 14 supported by one of the side walls of the barrel portion 2 of body 1. The bell-crank 13 engages at one end, through a slot 15, the pivot-pin 12 of lever 10 and carries at the other end a pin 16 engaging one end of a leaf spring 17 fastened at the opposite end to the grip portion 3 of body 1 by means of a rivet 18.

Figure 8:
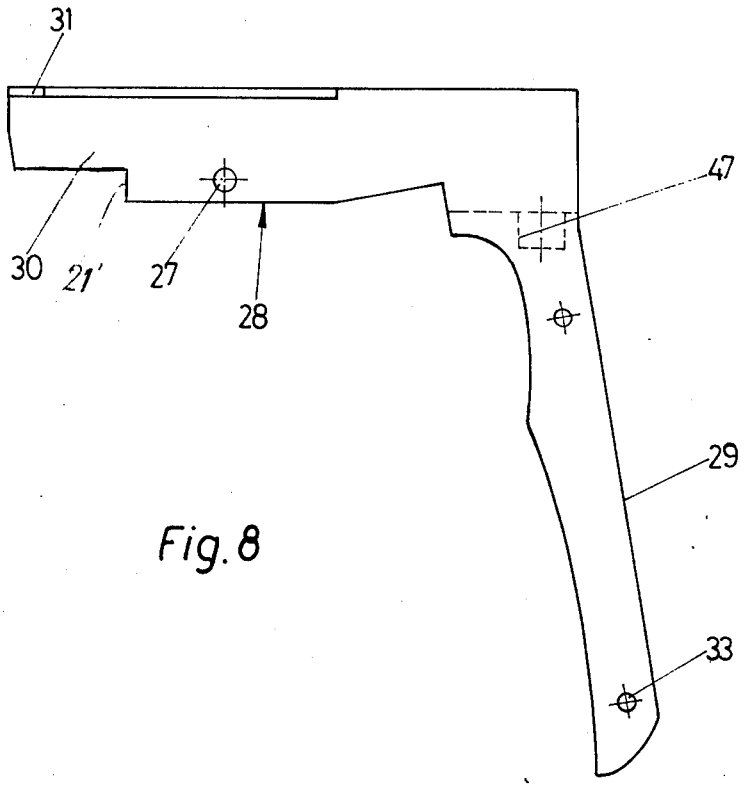
FIG. 8 is a side elevation view of the jaw operating lever.
Figure 9:
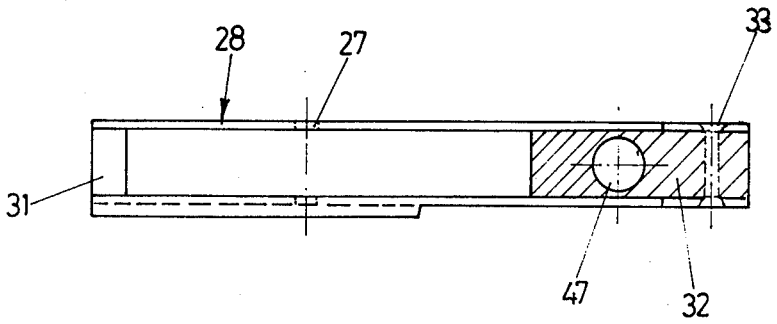
FIG. 9 is a top sectional view of the lever shown in FIG. 8.
Figure 11:
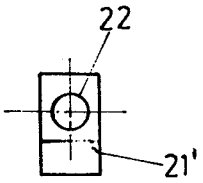
FIG. 11 is a front elevation view of the slide shown in FIG. 10.
Figure 10:
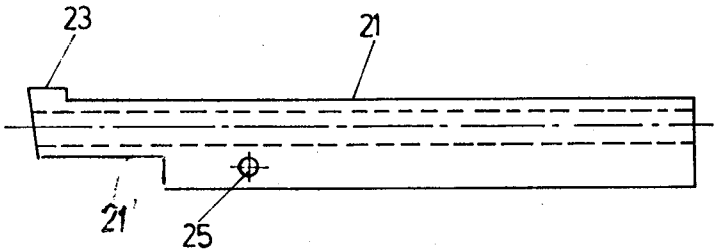
FIG. 10 is a side elevation view of the slide carrying one of the jaws.
Figure 12:
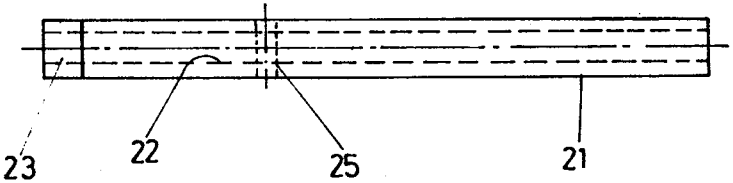
FIG. 12 is a plan view of the slide shown in FIGS. 10 and 11.

Inside the barrel portion 2 of body 1, a guide shaft 18 is arranged parallel to the longitudinal direction of the barrel portion, which shaft is supported at one end by plate 4 and at the opposite end by a block 19 inserted in the latter end and fastened to the side walls of the barrel portion 2 by means of a rivet 20. On the shaft 18 a slide 21 is slidingly mounted (see also FIGS. 10 to 12) having a longitudinal hole 22 therethrough, which is intended to receive the guiding shaft 18 and has at one end a projection 23 acting as a jaw. A recess 21' is provided on the lower surface of the slide 21 and is intended to permit the slide 21 to reciprocate without interfering with the pivot-pin 11. Between the slide 21 and the block 19 a spring 24 is arranged. In the slide 21 also a transverse hole 25 is provided, which is intended to receive a pivot-pin 26. On the latter a lever 28 is pivotally mounted at 27 (see also FIGS. 8 and 9), which lever 28 has a handle portion 29 extending parallel to the grip portion 3 of tool body 1, and a portion 30 extending parallel to the slide 21 and having at one end a cross-piece 31 acting as an upper jaw intended to cooperate with the lower jaw 23 of slide 21. Lever 20 is obtained from a metal-sheet which has been punched out and bent and the handle portion 29 is reinforced by means of an insert 32 arranged between two parallel walls of handle portion 29 and fastened to these walls by means of rivets 33 and 34.

In the grip portion 3 of the tool body 1 a handgrip 36 is pivotally mounted on a pivot-pin 35 carried by portion 3, which handgrip is provided with a hole 37 therethrough having a circular cross-section and extending at one end, in a portion 38 of square-cross-section. In the circular portion of bore 37 opposite that of square portion a shank of a screw 39 having a knurled head is inserted, said screw 39 engaging the pin 35 through a peripherical groove 40 of the screw 39. The shank of screw 39 has a threaded hole 41 in which a threaded rod 42 is screwed, said threaded rod carrying at the opposite end a square block 43 the side walls of which engage the walls of the square portion of hole 38. This portion of hole 38 faces an opening 44 provided in the lower wall of the barrel portion 2 of tool body 1 and having a slightly smaller diameter than a side of square portion of hole 38. A ball 45 is urged by a spring 46 interposed between the ball 45 and a block 43 into engagement with the walls of opening 44 so as to establish a releasable engagement between the handgrip 36 and the tool body 1. In this position the front wall of handgrip is in contact with both pin 16 and leaf spring 17.

In the top surface of the insert 32 of lever 29 a counterbored hole 47 is provided in which a return spring 48 arranged between the hole bottom and the slide 21 is housed.

The described tool operates as follows:

By means of the screw 39 the load of spring 46 is adjusted so that the release device comprised of this spring and ball 45 permits the handgrip 36 to rotate about the pivot-pin 35 only when the tension force exerted on the strap to be tightened has reached a predetermined value. Since the rod 42 is not permitted to rotate by the engagement of block 43 with the walls of the square hole 38, when turning the knurled head of screw 39, the engagement of the threads of hole 41 with the threaded portion of rod 42 causes the rod and therefore the block 43 fastened thereto to move in the direction of the axis of hole 41 thereby varying the spring rate of spring 46.

With the tool so preset for a given maximum tension force, the strap 49 is wrapped around the elements 50 to be tightened in a bundle (see FIG. 1) and the strap tail projecting from the head 51 of the strap is inserted into the slot 7 of plate 4. Then the tool is taken up by grasping the portion 29 of lever 28 by means of the fingers and holding on the palm of a hand the handgrip 36. By exerting a tension force on the lever 28, the latter rotates about the pivot 26 against the reaction of spring 47 and moves the jaw 31 against the facing jaw 23 so as to clamp between the two jaws the strap tail 49. The further tension exerted on the lever 28 will transmit the movement to the slide 21 which moves back against the reaction of spring 24. Thus, all moving elements, i.e. lever 28 and slide 21, move back carrying therewith the tail of strap 49 clamped between the jaws 31 and 23. Due to the tension force exerted on the strap, the latter tightens more and more around the conductor bundle 50. The load on spring 46 has been adjusted so that, when conductors 50 are tightened in a bundle, the tension force exerted on lever 29 exceeds the load of spring 46 plus, of course, the load of spring 17 so that handgrip 36, under the reaction of the palm of hand following the tension exerted by the fingers on the lever 28, releases the ball 45 out of engagement with the tool body 1 and rotates about pivot pin 35. During this rotational movement handgrip 36 by urging the pin 16 causes in turn the rotation of the ball-crank lever 13 about pivot 14. Due to the linkage between lever 13 and lever 10, the latter rotates about pivot 11 thereby causing the blade 8 to move towards strap 49.

Due to the clearance between the blade 8 and the blade supporting pivot 9 the blade is free to move along a straightline in the gap between plate 4 and front wall of the barrel portion 2 of tool body 1, said blade during this movement being guided by the engagement between pivot 9 and slot 6 provided in the plate 4. In order that the blade 8 during this movement does not interfere with the end of shaft 18, supported in the plate 4 a slot 52 is provided therein (see FIG. 7). Since the described movement of blade 8 occurs in a releasable manner the cutting edge of blade cuts the exceeding tail portion of the strap 49 clean-off and the cut portion can be ejected through the window 53 with the top wall of the barrel portion 2 of tool body 1 with the aid of an inclined plane 54 formed by a downwardly bent extension of said top wall of the barrel portion 2 provided at an edge of window 53.

After the strap has been cut the operator releases the handle 29 thereby permitting the spring 24 to return to a rest position the moving elements, i.e. slide 21 and lever 28. Simultaneously, the leaf spring 17 moves back the handgrip 36 until spring 46 causes ball 46 to seat again in the opening 44 of tool body 1 thereby resetting the engagement between handgrip and tool body. At the same time, the leaf spring 17, by acting on the pin 16 of the bell-crank lever 13, returns this lever and therefore also the lever 10 to the positions shown in FIG. 1 and blade 8 to a rest position. Jaws 23 and 31 are now again spread apart, ready to receive therebetween the tail of a new strap inserted through slot 7 of plate 4. The tool is ready to carry out a new tensioning operation of the strap tail with tightening thereof around a new bundle of thread-shaped articles and subsequent cutting of the exceeding tail portion.

From the foregoing description of the operation of the tool according to the invention it is seen that this tool is of very simple design and two essential advantages can be obtained thereby with respect to prior tools of this type:

1. Long tightening stroke with possibility to tighten at will the strap around the articles to be bound in a bundle.

2. Pinching over a reduced portion of the strap tail for dragging the strap which results in a reduced amount of scraps.

While only an embodiment of the invention has been described and shown it is obvious that various changes and modifications can be made thereto without departing from the scope of the invention.

What I claim is:

1. A tool for tightening and cutting self-locking straps, of the type comprising two jaws intended to restrain and tension the tail of the self-locking strap, a lever for actuating said jaws, a lever for actuating a blade intended to cut the exceeding portion of said strap, and a device for locking said blade actuating lever which unlocks said lever only when the tension exerted on said strap has reached a predetermined value, characterized in that one of said jaws is integral with said jaw actuating lever and the other jaw is integral with a slide adapted to slide on a guide parallel to the direction in which said strap is tensioned against the reaction of a spring interposed between said slide and a tool body, said jaw actuating lever being pivotally mounted on said slide.

2. A tool as claimed in claim 1, characterized in that said device for locking the blade actuating lever has a handle pivotally mounted at one end to the tool body and engaging at its opposite end said tool body by means of a release device, said handle being connected by means of a linkage to said blade actuating lever and being arranged so as to be gripped together with said jaw actuating lever.

3. A tool as claimed in claim 2, characterized in that a return spring is interposed between said jaw actuating lever and said slide carrying one of said jaws.

4. A tool as claimed in claim 3, characterized in that a return spring is interposed between said handle and said tool body.

5. A tool as claimed in claim 4, characterized in that said blade actuating lever is pivotally mounted on said tool body.

6. A tool as claimed in claim 5, characterized in that said blade is arranged in a hollow space provided in said tool body and is mounted with a clearance on a pivot pin carried by said blade actuating lever so as to perform linear movements in said hollow space when said lever rotates on its pivot.

7. A tool as claimed in claim 2, characterized in that said linkage between said handle and said blade actuating lever consists of a bell-crank lever pivotally mounted on said tool body and engaging at one end said blade actuating lever by means of a slotted link and at the other end said handle under the action of said return spring.

8. A tool as claimed in claim 7, characterized in that said return spring consists of a leaf spring secured at one end to said tool body.

9. A tool as claimed in claim 2, characterized in that the release device comprises a ball locked in a hole in said handle and urged by a spring arranged in said hole into engagement with an opening provided in said tool body.

10. A tool as claimed in claim 9, characterized in that said hole has a square cross-section and extends in a hole having a circular cross-section and a diameter lesser than a side of said square, which hole extends along the whole handle, and the spring locked in said hole having a square cross-section is interposed between said ball and a block having a square cross-section and secured to the end of a rod arranged within the hole having a circular cross-section and a threaded portion adapted to engage the thread of an adjusting screw having a shank with a counterbore and having outside a groove engaging a pin provided in said handle for axially restraining said screw, the head of said screw projecting from the end of said hole having a circular cross-section which is opposite to said hole having a square cross-section.

11. A tool as claimed in claim 10, characterized in that the pin engaging the adjusting screw is the pin on which said handle is pivotally mounted.

* * * * *